United States Patent [19]

Randall

[11] 4,070,983

[45] Jan. 31, 1978

[54] REVERSIBLE OUTBOARD MOTOR WITH EXHAUST GAS DISCHARGE CONTROL

[76] Inventor: Hubert E. Randall, Apt. F-12, New Rogers Road, Levittown, Pa. 19056

[21] Appl. No.: 753,646

[22] Filed: Dec. 23, 1976

[51] Int. Cl.[2] ..... B63H 5/13; B63H 21/26

[52] U.S. Cl. ..... 115/17; 416/93 A; 115/73

[58] Field of Search ..... 115/73, 17, 18 R, 34 R; 416/93 R, 93 A

[56] References Cited

U.S. PATENT DOCUMENTS

| | | | |
|---|---|---|---|
| 890,014 | 6/1908 | Barbour | 115/73 |
| 2,111,325 | 3/1938 | Linthwaite | 115/17 |
| 2,522,883 | 9/1950 | MacArthur | 115/73 |
| 2,564,903 | 8/1951 | Irgens | 115/17 |
| 2,955,559 | 10/1960 | Palmer | 114/281 |
| 3,745,964 | 7/1973 | Henrich | 115/73 |

*Primary Examiner*—Trygve M. Blix
*Assistant Examiner*—D. W. Keen
*Attorney, Agent, or Firm*—Zachary T. Wobensmith, 2nd; Zachary T. Wobensmith, III

[57] ABSTRACT

A reversible outboard motor is provided with structure for distribution of the exhaust gas from the motor away from the propeller and which may be integral or an attachment for existing outboard motors.

5 Claims, 4 Drawing Figures

REVERSIBLE OUTBOARD MOTOR WITH EXHAUST GAS DISCHARGE CONTROL

BACKGROUND OF THE INVENTION

1. Field of the Invention

This invention relates to outboard motors having reversible propellers and more particularly structure for distribution and delivery of the exhaust gas away from the propeller.

2. Description of the Prior Art

Outboard motors are in common use for boat propulsion.

Most of the outboard motors discharge the exhaust gas immediately above or downwardly and rearwardly of the propeller. Examples of this are shown in the U.S. patents to Irgens, U.S. Pat. Nos. 2,082,059, and 2,564,903, Henry, U.S. Pat. No. 2,601,396, and Holterman et al., U.S. Pat. No. 3,537,419.

The discharging gases may by a jet action aid in the forward propulsion of the boat but upon reversal the presence of the exhaust gas close to the propeller interferes with the action of the propeller so that it has very little pulling power.

SUMMARY OF THE INVENTION

In accordance with the invention an outboard motor having a reversible propeller is provided with an exhaust gas diverter to direct the exhaust gas away from the propeller and the portions of the water on which the propeller acts. Structure is provided for directing the gas preferably sidewise in opposite directions, and while it may be integral is preferably in the form of an attachment of sheet metal for use with existing outboard motors.

It is the principal object of the invention to provide improved apparatus in the form of an exhaust gas diverter for an outboard motor to direct the exhaust gas outwardly in opposite directions and away from the propeller so as not to interfere with reverse operation of the propeller.

It is a further object of the invention to provide a simple, effective and easily mounted attachment for use with presently operating outboard motors to improve the action of the propeller, particularly in reverse.

It is a further object of the invention to provide apparatus of the character aforesaid which further functions as a stop on the propeller housing for the rudder or by engagement with the boat.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

Figure 1:
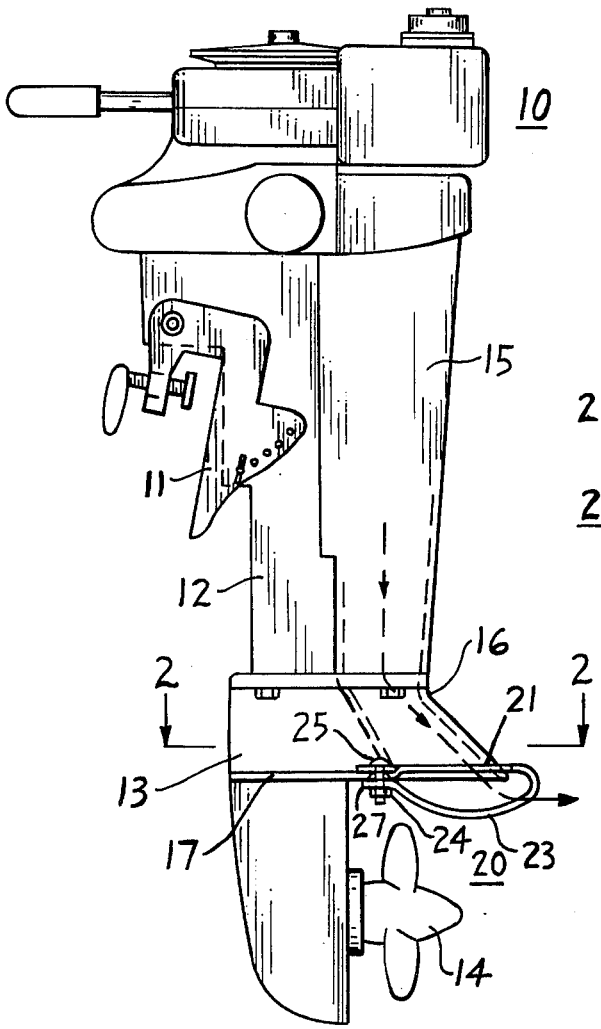
FIG. 1 is a side elevational view of an outboard motor having an exhaust gas diverter in accordance with the invention.
Figure 3:
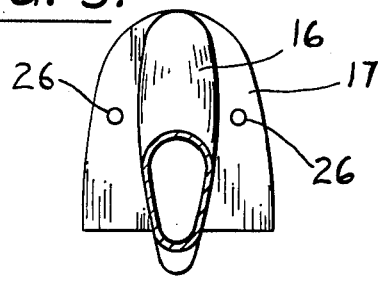
FIG. 3 is a view similar to FIG. 2 but prior to application of the exhaust gas diverter.
Figure 2:
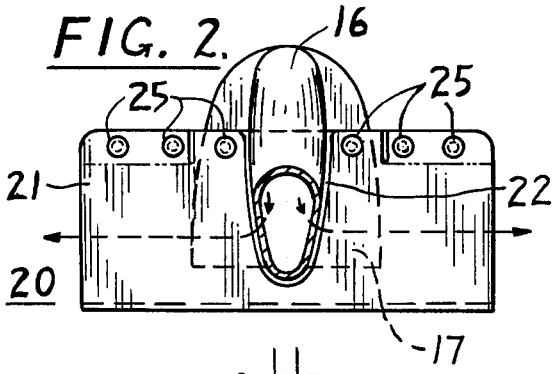
FIG. 2 is a horizontal sectional view taken approximately on the line 2—2 of FIG. 1.
Figure 4:
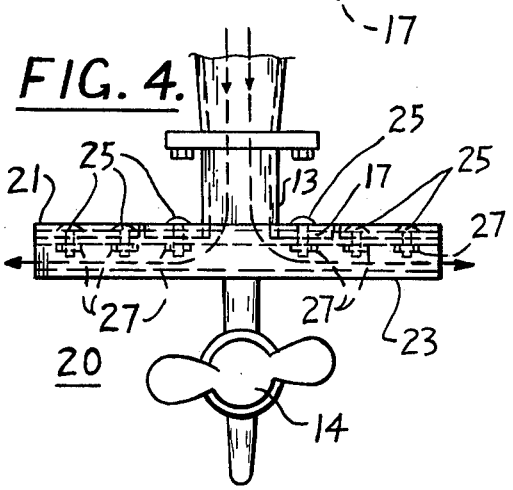
FIG. 4 is a fragmentary rear elevational view of the outboard motor of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings a reversible outboard motor 10 is illustrated having a mounting bracket 11 on a fixed housing section 12 for connection to the transom of a boat. A lower housing 13 which contains the drive shaft (not shown) for driving the propeller 14 is pivotally connected to the fixed housing section 12 in a well known manner and the exhaust pipe 15 is connected to the lower housing 13 for movement therewith. The exhaust pipe 15 has a downwardly and rearwardly inclined pipe section 16, which extends to a horizontal plate 17 which serves as an anti-cavitation plate.

In accordance with the present invention the exhaust pipe section 16 has a diverter 20 connected thereto. The diverter 20 may be made integral with the plate 17 but in order that the diverter 20 can be applied to outboard motors now in use it can advantageously be made of sheet metal, such as stainless steel or other material which is resistant to corrosion particuarly if for use in salt or brackish water.

As illustrated, the diverter 20 has an upper flat wall portion 21 for positioning on the top face of the plate 17 with an opening 22 for disposition around the pipe section 16. The diverter 20, integral with the wall portion 21, has a lower curved wall portion 23 which extends around the rear edge of the plate 17 and then forwardly beneath the plate 17. The lower wall portion 23 is of substantially semi-oval or semi-circular shape in transverse cross section with a rear flange 24. It may be necessary with some outboard motors to remove a portion of the pipe section 16 which extends below the plate 17 to permit the exhaust gas to enter the interior of the diverter 20.

The diverter 20 can be held in place in any desired manner. A plurality of screws 25 extending downwardly through upper wall section 21, through holes 26 for that purpose through the plate 17 and through the rear flange 24, with retaining nuts 27 has been found suitable.

The width of the diverter 20 is preferably greater than the diameter of the propeller 14 to serve as a limit stop at each end for the rudder (not shown) to prevent turning of the rudder into the blades of the propeller 14 or for the diverter itself.

The cross sectional area of the diverter 20, as seen in FIG. 1, is preferably equal to the area of the exhaust pipe 15 to permit of free discharge of exhaust gas from the motor and the avoidance of any undesired back pressure.

In use, the exhaust gas from the motor delivered through the exhaust pipe 15 and the pipe section 16 is delivered into the interior of the diverter 20 where it divides and flows horizontally outwardly in both directions below the surface of the water. The distribution of the exhaust gas in this manner is particularly helpful with the propeller 14 running in reverse as the exhaust gas does not interfere with reverse propeller operation.

I claim:

1. A marine propulsion device for an outboard motor having an exhaust gas delivery pipe, an anti-cavitation plate and a propeller below said plate which comprises an exhaust gas diverter carried by cavitation plate and having a central inlet connected to the exhaust gas delivery pipe and, in direct communication with said inlet, opposite outwardly disposed horizontal tubular discharge passageways with their terminal ends separated at least as far apart as the diameter of the propeller.

2. The combination defined in claim 1 in which said discharge passageways are disposed below said anti-cavitation plate.

3. The combination defined in claim 1 in which said diverter is made of sheet material and is secured to the anti-cavitation plate, and the diverter has said tubular passageways disposed below the anti-cavitation plate for directing the exhaust gas transversely outwardly with respect to the gas delivery pipe.

4. The combination defined in claim 3 in which said diverter is detachably secured to said plate.

5. The combination defined in claim 1 in which the area of the tubular portions is not less than the area of the exhaust gas delivery pipe.

* * * * *